US006623692B2

(12) United States Patent
Jackson et al.

(10) Patent No.: US 6,623,692 B2
(45) Date of Patent: Sep. 23, 2003

(54) RHODIUM-BASED ALLOY AND ARTICLES MADE THEREFROM

(75) Inventors: Melvin Robert Jackson, Niskayuna, NY (US); Charles Gitahi Mukira, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 60 days.

(21) Appl. No.: 10/050,699

(22) Filed: Jan. 18, 2002

(65) Prior Publication Data

US 2003/0049156 A1 Mar. 13, 2003

Related U.S. Application Data

(63) Continuation-in-part of application No. 09/682,391, filed on Aug. 29, 2001, now abandoned.

(51) Int. Cl.[7] ..... C22C 5/04
(52) U.S. Cl. ..... 420/462
(58) Field of Search ..... 420/462; 148/407

(56) References Cited

U.S. PATENT DOCUMENTS 2,803,925 A * 8/1957 Kalusmann ..... 420/462
3,248,190 A * 4/1966 Woodward et al. ..... 420/462
6,071,470 A * 6/2000 Koizumi et al. ..... 420/462

OTHER PUBLICATIONS

Rh–Base Refractory Superalloys For Ultra–High Temperature Use, Y. Yamabe–Mitarai, Y. Koizumi, H. Murakami, Y. Ro, T. Maruko and H. Harada, Scripta Materialia, vol. 36, No. 4, pp. 393–398, 1997.

Ir–Base Refractory Superalloys for Ultra–High Temperatures, Y. Yamabe–Mitarai, Y. Ro, T. Maruko, and H. Harada, Metallurgical and Materials Transactions A, vol. 29A, Feb. 1998, pp. 537–549.

Development of Ir–Base Refractory Superalloys, Y. Yamabe, Y. Koizumi, H. Murakami, Y. Ro, T. Maruko and H. Harada, Scripta Materialia, vol. 35, No. 2, pp. 211–215. 1996.

* cited by examiner

*Primary Examiner*—Deborah Yee
(74) *Attorney, Agent, or Firm*—Paul J. DiConza; Patrick K. Patnode

(57) ABSTRACT

An alloy and a gas turbine engine component comprising an alloy are presented, with the alloy comprising from about three atomic percent to about nine atomic percent of at least one precipitation-strengthening metal selected from the group consisting of zirconium, niobium, tantalum, titanium, hafnium, and mixtures thereof; from about one atomic percent to about five atomic percent ruthenium; and the balance rhodium; the alloy further comprising a face-centered-cubic phase and an L12—structured phase.

29 Claims, 2 Drawing Sheets

RHODIUM-BASED ALLOY AND ARTICLES MADE THEREFROM

This application is a Continuation-In-Part of application Ser. No. 09/682,391 filed on Aug. 29, 2001, now abandoned.

BACKGROUND OF THE INVENTION

The present invention relates to materials designed to withstand high temperatures. More particularly, this invention relates to heat-resistant alloys for high-temperature applications, such as, for instance, gas turbine engine components of aircraft engines and power generation equipment.

There is a continuing demand in many industries, notably in the aircraft engine and power generation industries where efficiency directly relates to operating temperature, for alloys that exhibit sufficient levels of strength and oxidation resistance at increasingly higher temperatures. Gas turbine airfoils on such components as vanes and blades are usually made of materials known in the art as "superalloys." The term "superalloy" is usually intended to embrace iron-, cobalt-, or nickel-based alloys, which include one or more additional elements to enhance high temperature performance, including such non-limiting examples as aluminum, tungsten, molybdenum, titanium, and iron. The term "based" as used in, for example, "nickel-based superalloy" is widely accepted in the art to mean that the element upon which the alloy is "based" is the single largest elemental component by weight in the alloy composition. Generally recognized to have service capabilities limited to a temperature of about 1100° C. (about 2012° F.), conventional superalloys used in gas turbine airfoils often operate at the upper limits of their practical service temperature range. In typical jet engines, for example, bulk average airfoil temperatures range between about 898° C. (about 1650° F.) to about 982 ° C. (about 1800° F.), while airfoil leading and trailing edge and tip temperatures often reach about 1149° C. (about 2100° F.) or more. At such elevated temperatures, the oxidation process consumes conventional superalloy parts, forming a weak, brittle metal oxide that is prone to chip or spall away from the part. Maximum temperatures are expected in future applications to be over about 1315° C. (about 2400° F.), at which point many conventional superalloys begin to melt. Clearly, new materials must be developed if the efficiency enhancements available at higher operating temperatures are to be exploited.

The so-called "refractory superalloys," as described in Koizumi et al., U.S. Pat. No. 6,071,470, represent a class of alloys designed to operate at higher temperatures than those of conventional superalloys. According to Koizumi et al., refractory superalloys consist essentially of a primary constituent selected from the group consisting of iridium (Ir), rhodium (Rh), and a mixture thereof, and one or more additive elements selected from the group consisting of niobium (Nb), tantalum (Ta), hafnium (Hf), zirconium (Zr), uranium (U), vanadium (V), titanium (Ti), and aluminum (Al). The refractory superalloys have a microstructure containing an FCC (face-centered cubic)-type crystalline structure phase and an $L1_2$—type crystalline structure phase, and the one or more additive elements are present in a total amount within the range of from 2 atom % to 22 atom %. As used herein, the term "refractory superalloy" is not limited to the definition of Koizumi et al., but it is used to refer to any alloy comprising a primary constituent (i.e., single largest constituent by weight) selected from the group consisting of rhodium and iridium, and further comprising an FCC (face-centered cubic)-type crystalline structure phase and an $L1_2$—type crystalline structure phase.

SUMMARY OF THE INVENTION

Although the refractory superalloys have shown potential to become replacements for conventional superalloys in present and future gas turbine engine designs, it has been shown that many alloys of this class do not meet all of the desired performance criteria for high-temperature applications. Therefore, the need persists for refractory superalloys with improved high-temperature properties.

The present invention provides several embodiments that address this need. One embodiment is an alloy comprising from about three atomic percent to about nine atomic percent of at least one precipitation-strengthening metal selected from the group consisting of zirconium, niobium, tantalum, titanium, hafnium, and mixtures thereof; from about one atomic percent to about five atomic percent ruthenium (Ru); and the balance rhodium; the alloy further comprising a face-centered-cubic phase and an $L1_2$—structured phase.

A second embodiment is a gas turbine engine component comprising an alloy, the alloy of the component comprising from about three atomic percent to about nine atomic percent of at least one precipitation-strengthening metal selected from the group consisting of zirconium, niobium, tantalum, titanium, hafnium, and mixtures thereof; from about one atomic percent to about five atomic percent ruthenium; and the balance rhodium; the alloy of the gas turbine engine component further comprising a face-centered-cubic phase and an $L1_2$—structured phase.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
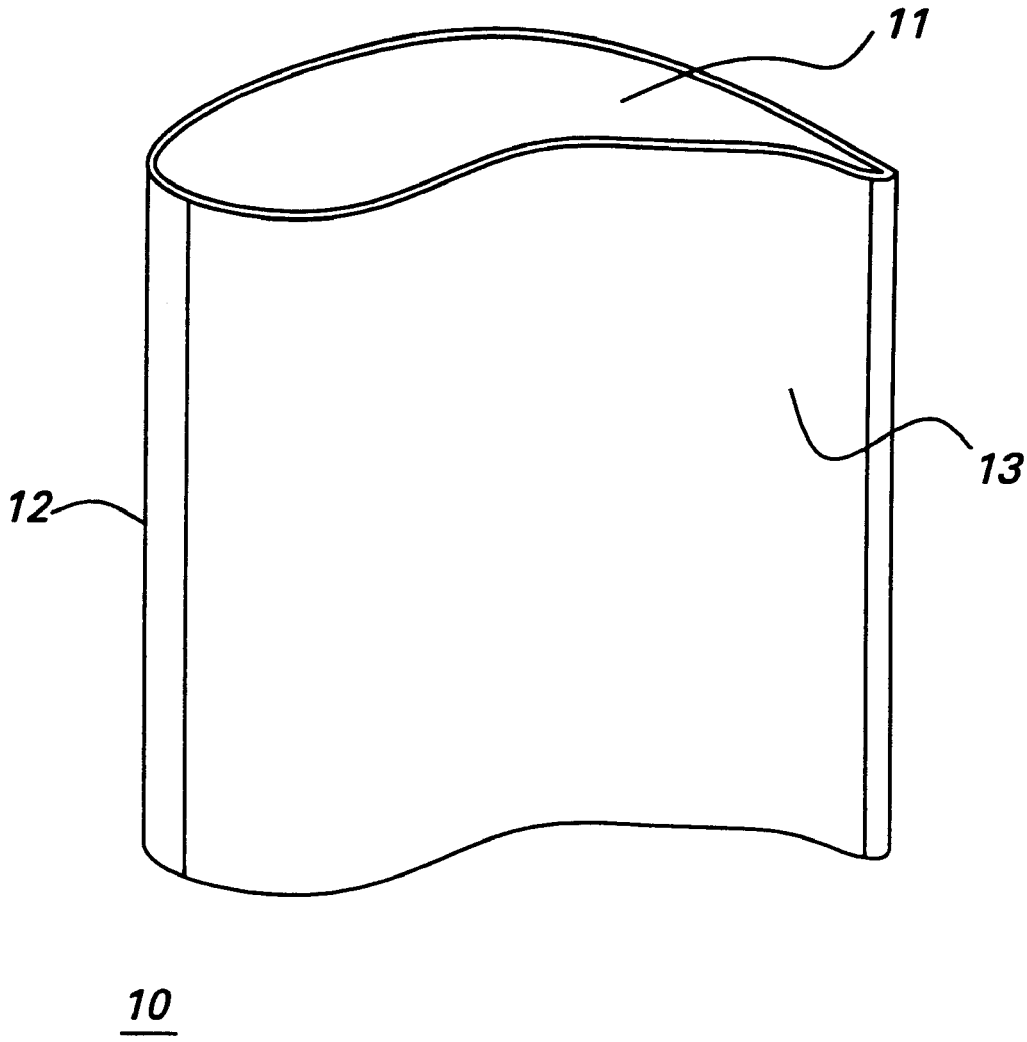
FIG. 1 is an isometric view of an airfoil as typically found on a gas turbine engine component.

The discussion herein employs examples taken from the gas turbine industry, particularly the portions of the gas turbine industry concerned with the design, manufacture, operation, and repair of aircraft engines and power generation turbines.

However, the scope of the invention is not limited to only these specific industries, as the embodiments of the present invention are applicable to many and various applications that require materials resistant to high temperature and aggressive environments. Unless otherwise noted, the temperature range of interest where statements and comparisons are made concerning material properties is from about 982° C. (about 1800° F.) to about 1315° C. (about 2400° F.).

In several high temperature applications, such as, for example, gas turbines, the selection of structural materials is made based upon the performance of materials for a number of different properties. For gas turbine components, including, for example, turbine blades (also known as "buckets") and vanes (also known as "nozzles"), where the maximum metal temperatures typically range from about 982° C. (about 1800° F.) to over about 1204° C. (about 2200° F.) in present systems and temperatures over about 1315° C. (about 2400° F.) are envisioned for future applications, the properties that are considered include, for example, oxidation resistance, melting temperature (the temperature at which liquid metal begins to form as the material is heated), strength, ductility, density (ratio of mass to volume), coefficient of thermal expansion, and modulus of elasticity.

The term "oxidation resistance" is used in the art to refer to the amount of damage sustained by a material when exposed to oxidizing environments, such as, for example, high temperature gases containing oxygen. Oxidation resistance is related to the rate at which the weight of a specimen changes per unit surface area during exposure at a given temperature. In many cases, the weight change is measured to be a net loss in weight as metal is converted to oxide that later detaches and falls away from the surface. In other cases, a specimen may gain weight if the oxide tends to adhere to the specimen, or if the oxide forms within the specimen underneath the surface, a condition called "internal oxidation." A material is said to have "higher" or "greater" oxidation resistance than another if the material's rate of weight change per unit surface area is closer to zero than that of the other material for exposure to the same environment and temperature. Numerically, oxidation resistance can be represented by the time over which an oxidation test was run divided by the absolute value of the weight change per unit area.

"Strength" as used herein refers to the ultimate tensile strength of a material, which is defined in the art to mean the maximum load sustained by a specimen in a standard tensile test divided by the original cross-sectional area (i.e., the cross-sectional area of the specimen prior to applying the load).

Ductility may be quantified in a number of ways well known in the art. The quantity used herein as a measure of a material's ductility is "strain to failure," which is defined as the total amount of strain exhibited by a specimen in a standard tensile test prior to fracture. A material is said to be more ductile than another if it exhibits more strain to failure than the material to which it is being compared.

Coefficient of thermal expansion ($\alpha$) is the change in unit length exhibited by a specimen of material per degree change in temperature. Modulus of elasticity (E) is the ratio of tensile stress divided by tensile strain for elastic deformation. These two quantities are considered in turbine material design and selection because the product of these two quantities is proportional to the amount of elastic stress generated between joined materials of differing thermal expansion coefficients. Therefore, to minimize stresses, the product of E and $\alpha$ is kept as low as possible.

Refractory superalloys, with their high content of highly environmentally resistant elements such as iridium and rhodium, represent a class of materials with potential for use in high temperature applications. However, as the data in Table 1 indicate, several refractory superalloys with compositions according to aforementioned U.S. Pat. No. 6,071,470 do not approach the oxidation resistance of a standard nickel-based superalloy at a temperature of about 1204° C. (about 2200° F.).

TABLE 1

Oxidation resistance for selected alloys

| Alloy Designation (composition numbers refer to atomic percent) | Oxidation Resistance ($hr/cm^2$-mg) 100 hr. test at about 1204° C. |
|---|---|
| 1-A (Nickel-based superalloy) | 16.7 |
| 1-B (15 Zr + bal. Ir) | 0.9 |
| 1-C (7 Zr + bal. Rh) | 7.1 |
| 1-D (10 Zr + 6 Nb + bal. Rh) | 1.2 |

In refractory superalloy systems, oxidation resistance is primarily derived from the presence of certain metals selected from the so-called "platinum group" in the FCC phase. The platinum group comprises platinum, palladium, rhodium, iridium, rhenium, ruthenium, and osmium. Where the primary constituent of a refractory superalloy is rhodium, iridium, or mixtures thereof, strength is primarily derived by the addition of elements that promote the formation of the $L1_2$—structured phase. Because the $L1_2$—structured phase usually forms in these alloys by a precipitation mechanism from the supersaturated FCC ("matrix") phase, the elements that promote the formation of the $L1_2$—structured phase are referred to herein as "precipitate strengthening metals." Such metals include, for example, zirconium, niobium, tantalum, titanium, hafnium, and mixtures thereof. The $L1_2$—structured phase has a generic chemical formula of $M_3X$, where M is a platinum group metal and X is a precipitate strengthening metal. As the proportion of precipitate strengthening metal in the alloy increases, the volume fraction of $L1_2$—structured phase increases, which increases the strength of the alloy. However, as the volume fraction of $L1_2$—structured phase increases, the amount of platinum group metal present in the FCC matrix phase to provide oxidation resistance decreases—it is "tied up" in the $L1_2$—structured phase. The design of a suitable refractory superalloy therefore must consider carefully the required balance between strength and oxidation resistance.

Those skilled in the art will appreciate that the typical tradeoff between strength and ductility is also an important consideration in the design of refractory superalloys. As the volume fraction of $L1_2$—structured phase increases, the increase in strength is accompanied by a decrease in ductility, which may detract from the suitability of the alloy to perform in certain applications.

Although precipitation strengthening is the primary strengthening mechanism in the refractory superalloys, the addition of certain elements provides a smaller, but significant, amount of solution strengthening. These elements remain dissolved in the FCC phase and serve as a barrier to deformation of the alloy by straining the crystalline structure of the FCC phase. Metals of this type, referred to herein as "solution-strengthening metals," include, for example, molybdenum, tungsten, rhenium, and mixtures thereof.

Formulation of refractory superalloys is dependent upon an understanding of the property requirements needed for particular applications, and the relationship between alloy composition and properties. Embodiments of the present invention represent a specific "window" of composition based upon such an understanding, and show extraordinary results when compared with other refractory superalloys.

One embodiment of the present invention is an alloy comprising from about three atomic percent to about nine atomic percent of at least one precipitation-strengthening metal selected from the group consisting of zirconium, niobium, tantalum, titanium, hafnium, and mixtures thereof; from about one atomic percent to about five atomic percent ruthenium; and the balance rhodium; the alloy further comprising a face-centered-cubic phase and an $L1_2$—structured phase. The $L1_2$—structured phase in the alloy of the present invention has substantially the same characteristics and generic composition as described above for the refractory superalloys in general. The alloy composition of the present invention is thus classified as a rhodium-based alloy, because rhodium is the single largest elemental component in the composition. Rhodium has a density of 12.4 g/cm$^3$, which is only about 55% that of iridium. In addition, rhodium has better oxidation resistance than iridium in the temperature range of interest herein, and has a lower Ea factor (270 vs. 340 for iridium).

In certain embodiments, the alloy of the present invention further comprises at least one solution-strengthening metal selected from the group consisting of molybdenum, tungsten, rhenium, and mixtures thereof, in order to enhance alloy strength. In particular embodiments, the alloy of the present invention comprises up to about four atomic percent of the at least one solution-strengthening metal. In some embodiments, the alloy of the present invention further comprises at least one of platinum and palladium. The platinum and palladium additions substitute for the rhodium in providing oxidation resistance in the FCC matrix phase as well as participating in the formation of the $L1_2$—structured phase. In certain particular embodiments, the alloy of the present invention comprises up to about ten atomic percent platinum, and in still further particular embodiments, the alloy of the present invention alloy comprises up to about ten atomic percent palladium.

Some embodiments provide that the alloy of the present invention comprises from about 1.5 atomic percent to about 4 atomic percent ruthenium, and for specific embodiments, the alloy of the present invention comprises about 2 atomic percent ruthenium. In certain embodiments, the precipitation-strengthening metal comprises a material selected from the group consisting of zirconium, niobium, tantalum, and mixtures thereof.

In certain embodiments, the alloy of the present invention has an oxidation resistance of at least about 16 hour-cm$^2$/mg at a temperature of about 1204° C. (about 2200° F.) which is at least about as high as the oxidation resistance of the baseline nickel-based superalloy in Table 1. Certain embodiments are provided in which the alloy has an ultimate tensile strength greater than about 172 megapascals (MPa) (about 25,000 pounds per square inch (25 ksi)) at a temperature of about 1204° C. (about 2200° F.), and in some embodiments, the alloy has a strain to failure of at least about 2% at a temperature of about 1204° C. (about 2200° F.). In order to maintain the balance described above between strength and oxidation resistance, some embodiments provide that the alloy of the present invention comprises a volume fraction of the $L1_2$—structured phase not greater than about 30 volume %.

To further capitalize on the benefits set forth above, certain embodiments of the present invention provide an alloy consisting essentially of from about three atomic percent to about nine atomic percent of at least one precipitation-strengthening metal selected from the group consisting of zirconium, niobium, tantalum, titanium, hafnium, and mixtures thereof; up to about four atomic percent of at least one solution-strengthening metal selected from the group consisting of molybdenum, tungsten, rhenium, and mixtures thereof; from about 1.5 atomic percent to about four atomic percent ruthenium; up to about ten atomic percent platinum; up to about ten atomic percent palladium; and the balance rhodium; wherein the microstructure of the alloy comprises a face-centered-cubic phase and an $L1_2$—structured phase. In particular embodiments, the alloy of the present invention consists essentially of about seven atomic percent of at least one precipitation-strengthening metal selected from the group consisting of zirconium, niobium, tantalum, and mixtures thereof; about two atomic percent ruthenium; and the balance comprising rhodium; wherein the microstructure of the alloy comprises a face-centered-cubic phase and an $L1_2$—structured phase. In specific embodiments, the alloy of the present invention consists essentially of about seven atomic percent zirconium; about two atomic percent ruthenium; and the balance rhodium; the alloy further comprising a face-centered-cubic phase and an $L1_2$—structured phase.

Those skilled in the art will appreciate that additions of carbon and boron to the embodiments of the present invention may marginally improve strength and other properties as they do in many other alloy systems, and that such additions are generally up to about 0.25 atomic percent for each of these two elements. Furthermore, incidental impurities, such as nickel, cobalt, chromium, iron, and other metals, are often present in processed alloys and may be present in alloys provided by the present invention in amounts of up to about 0.5 atomic percent, for example. Another embodiment of the present invention provides a gas turbine engine component comprising the alloy of the present invention. The alternatives for composition and properties of the alloy in these gas turbine engine component embodiments are the same as discussed above for the alloy embodiments.

In some embodiments, the gas turbine engine component is a blade of an aircraft engine, a vane of an aircraft engine, a bucket of a power generation turbine engine, or a nozzle of a power generation turbine. Referring to FIG. 1, in particular embodiments the gas turbine engine component comprises an airfoil 10, and the airfoil comprises the alloy. Specific embodiments provide that the airfoil 10 comprises a tip section 11, a leading edge section 12, and a trailing edge section 13, and wherein at least one of said tip section 11, said leading edge section 12, and said trailing edge section 13 comprises said alloy. Having only particular sections (i.e., those sections known to experience the most aggressive stress-temperature combinations) of the airfoil comprise the alloy of the present invention minimizes certain drawbacks of rhodium-based high temperature alloys, including their high cost and high density, in that these drawbacks have a reduced effect on the overall component because the rhodium-based high temperature alloy comprises only a fraction of the overall surface area of the component. The properties of the component are thus "tailored" to the expected localized environments, reducing the need for compromise during the design process and increasing the expected operating lifetimes for new and repaired components.

Alloys set forth herein as embodiments of the present invention are made using any of the various traditional methods of metal production and forming. Traditional casting, powder metallurgical processing, directional solidification, and single-crystal solidification are non-limiting examples of methods suitable for forming ingots of these alloys. Thermal and thermo-mechanical processing techniques common in the art for the formation of other precipitation-hardened alloys are suitable for use in strengthening the alloys of the present invention. In general, precipitation-hardened alloys are often subjected to a series of heat treatments in which the first treatment achieves a single phase structure at high temperature, followed by a rapid quench, and finally an aging treatment at a lower temperature wherein the strengthening phase (the $L1_2$—structured phase in the case of refractory superalloys) precipitates from the supersaturated matrix phase (FCC phase in the case of refractory superalloys). For situations where refractory superalloys, including the alloys of the present invention, are joined to a Ni-base superalloy, heat treatments are limited to temperatures below those that will degrade or melt the Ni alloy. These temperatures may not provide full dissolution of the $L1_2$—structured phase.

The examples presented below are intended to demonstrate the extraordinary results obtained with alloys of the present invention and are not to be considered as limiting the scope of the present invention in any way.

EXAMPLE 1

Several alloys were prepared for an oxidation test to be run for 100 hours at a temperature of about 1204° C. (about 2200° F.). The tested compositions are presented in Table 2.

TABLE 2

Alloy compositions and data for 100-hour oxidation test at about 1204° C.

| Designation | Composition (numbers represent atomic percent) | Oxidation Resistance (hr/cm$^2$-mg) |
|---|---|---|
| 2-A | (Nickel-based superalloy) | 16.7 |
| 2-B | 7 Zr + bal. Rh | 7.2 |
| 2-C | 7 Zr + 2 Re + bal. Rh | 9.0 |
| 2-D | 7 Zr + 10 Pt + bal. Rh | 8.2 |
| 2-E | 7 Zr + 2 W + bal. Rh | 13.9 |
| 2-F | 7 Zr + 2 Ru + bal. Rh | 167 |
| 2-G | 15 Zr + bal. Ir | 0.9 |

Figure 2:
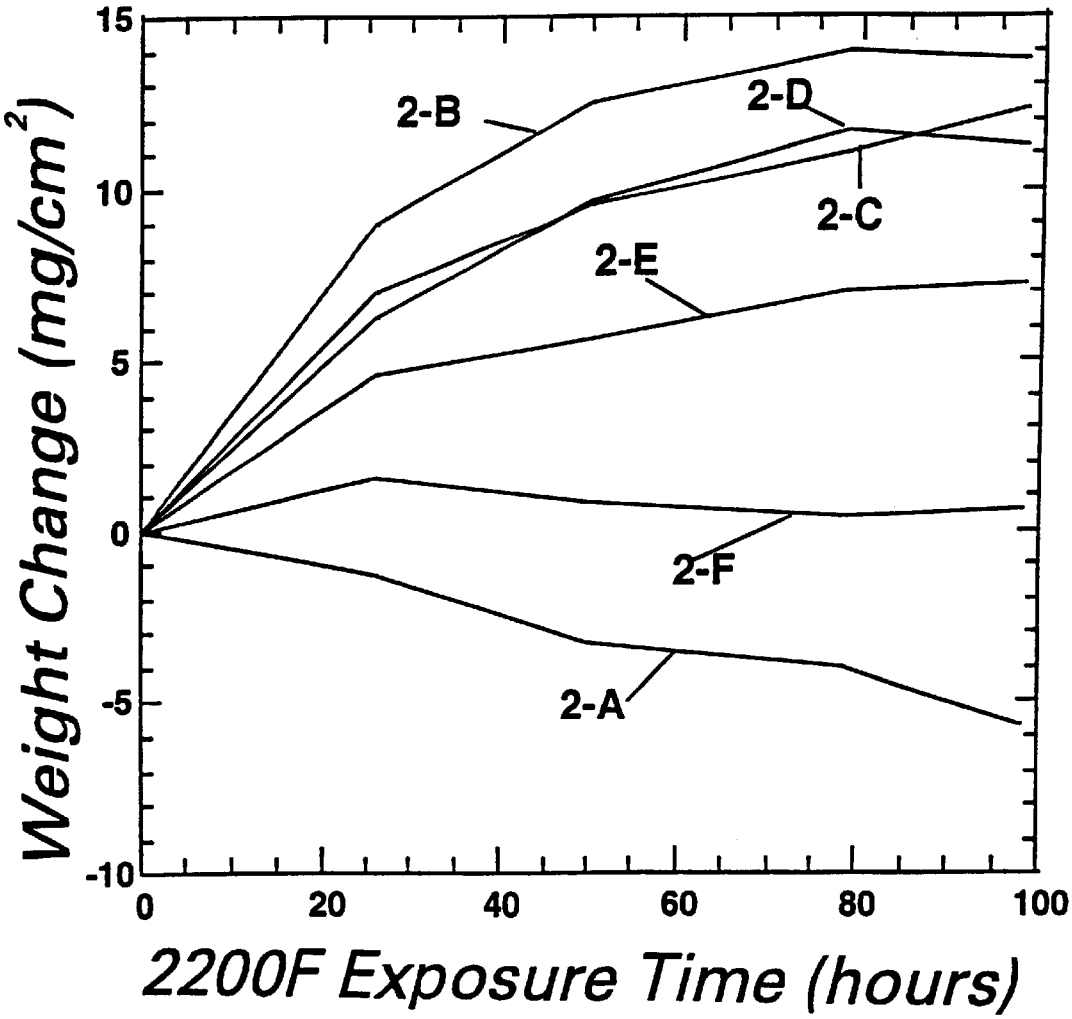
FIG. 2 is a graph of oxidation data.

Alloy 2-A, a nickel-based superalloy, was selected as a baseline for comparison. The weight change data as a function of time is plotted for alloys 2-A through 2-F in FIG. 2 and the oxidation resistance data after 100 hours of testing is summarized in Table 2. Alloy 2-F, an alloy with a composition in accordance with embodiments of the present invention, was the only alloy with oxidation resistance greater than that of the baseline Alloy 2-A. Note the poor performance of Alloy 2-G, the Ir-based alloy. Alloys based on Ir, and indeed pure Ir, were observed to exhibit unsuitably rapid loss of material at temperatures in the range from about 1204° C. (about 2200° F.) to about 1316° C. (about 2400° F.). Rh-based alloys tended to exhibit weight gains due to internal oxidation.

EXAMPLE 2

Three alloys were prepared for an oxidation test to be run for 200 hours at a temperature of about 1316° C. (about 2400° F.). The compositions and oxidation resistance data are given in Table 3. Additionally, data for a 100 hour test performed at substantially the same temperature on alloy 2-F are presented.

TABLE 3

Alloy compositions and data for 200-hour oxidation test at about 1316° C.

| Designation | Composition | Oxidation Resistance (hr/cm$^2$-mg) |
|---|---|---|
| 3-A | 7 Zr + 4 Ru + bal. Rh | 1000 |
| 3-B | 7 Zr + 6 Ru + bal. Rh | 9.5 |
| 2-F | 7 Zr + 2 Ru + bal. Rh | 35 (100 hour test) |

Alloy 3-A, with 4 atomic percent Ru, had an acceptably high oxidation resistance, but when the Ru content was increased to six atomic percent, as in Alloy 3-B, the oxidation resistance decreased substantially to below that measured previously for nickel-based superalloy 2-A. The addition of an amount of Ru in the range described above for embodiments of the present invention appears to limit the effect of oxygen on the alloy, inhibiting both internal and external oxidation. Nickel-base superalloys oxidize very rapidly at temperatures of about 1316° C.-this temperature is close to the melting temperature of most nickel-based alloys.

EXAMPLE 3

Alloy 2-G was tensile tested at about 1204° C. (about 2200° F.). The test was stopped before failure, and a strength of about 255 MPa (about 37 ksi) and an elongation of about 3% were demonstrated at the point the test was halted.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An alloy comprising:

from about three atomic percent to about nine atomic percent of at least one precipitation-strengthening metal selected from the group consisting of zirconium, niobium, tantalum, titanium, hafnium, and mixtures thereof;

from about one atomic percent to about five atomic percent ruthenium; and the balance rhodium;

said alloy further comprising a face-centered-cubic phase and an $L1_2$—structured phase.

2. The alloy of claim 1, further comprising at least one solution-strengthening metal selected from the group consisting of molybdenum, tungsten, rhenium, and mixtures thereof.

3. The alloy of claim 2, wherein said alloy comprises up to about four atomic percent of said at least one solution-strengthening metal.

4. The alloy of claim 1, wherein said alloy further comprises at least one of platinum and palladium.

5. The alloy of claim 4, wherein said alloy comprises up to about ten atomic percent platinum.

6. The alloy of claim 5, wherein said alloy comprises up to about ten atomic percent palladium.

7. The alloy of claim 1, wherein said alloy comprises from about 1.5 atomic percent to about 4 atomic percent ruthenium.

8. The alloy of claim 7, wherein said alloy comprises about 2 atomic percent ruthenium.

9. The alloy of claim 1, wherein said precipitation-strengthening metal comprises a material selected from the group consisting of zirconium, niobium, tantalum, and mixtures thereof.

10. The alloy of claim 1, wherein said alloy has an oxidation resistance of at least about 16 hour-cm2/mg at a temperature of about 1204° C. (about 2200° F.).

11. The alloy of claim 1, wherein said alloy has an ultimate tensile strength greater than about 172 MPa (about 25 ksi) at a temperature of about 1204° C. (about 2200° F.).

12. The alloy of claim 1, wherein said alloy has a strain to failure of at least about 2% at a temperature of about 1204° C. (about 2200° F.).

13. The alloy of claim 1, wherein said alloy comprises a volume fraction of said $L1_2$—structured phase not greater than about 30 volume %.

14. An alloy consisting essentially of:

from about three atomic percent to about nine atomic percent of at least one precipitation-strengthening metal selected from the group consisting of zirconium, niobium, tantalum, titanium, hafnium, and mixtures thereof;

up to about four atomic percent of at least one solution-strengthening metal selected from the group consisting of molybdenum, tungsten, rhenium, and mixtures thereof;

from about 1.5 atomic percent to about four atomic percent ruthenium;

up to about ten atomic percent platinum;

up to about ten atomic percent palladium; and the balance rhodium;

wherein the microstructure of said alloy comprises a face-centered-cubic phase and an $L1_2$—structured phase.

15. An alloy consisting essentially of:

about seven atomic percent of at least one precipitation-strengthening metal selected from the group consisting of zirconium, niobium, tantalum, and mixtures thereof;

about two atomic percent ruthenium; and the balance rhodium;

wherein the microstructure of said alloy comprises a face-centered-cubic phase and an $L1_2$—structured phase.

16. An alloy consisting essentially of:

about seven atomic percent zirconium;

about two atomic percent ruthenium; and the balance rhodium;

wherein the microstructure of said alloy comprises a face-centered-cubic phase and an $L1_2$—structured phase.

17. A gas turbine engine component comprising an alloy, said alloy of said component comprising from about three atomic percent to about nine atomic percent of at least one precipitation-strengthening metal selected from the group consisting of zirconium, niobium, tantalum, titanium, hafnium, and mixtures thereof, from about one atomic percent to about five atomic percent ruthenium, and the balance rhodium, said alloy of said gas turbine engine component further comprising a face-centered-cubic phase and an $L1_2$—structured phase.

18. The turbine engine component of claim 17, wherein said alloy of said component further comprises at least one solution-strengthening metal selected from the group consisting of molybdenum, tungsten, rhenium, and mixtures thereof.

19. The turbine engine component of claim 18, wherein said alloy of said component comprises up to about four atomic percent of said at least one solution-strengthening metal.

20. The turbine engine component of claim 17, wherein said alloy of said component further comprises at least one of platinum and palladium.

21. The turbine engine component of claim 20, wherein said alloy of said component comprises up to about ten atomic percent platinum.

22. The turbine engine component of claim 21, wherein said alloy of said component comprises up to about ten atomic percent palladium.

23. The turbine engine component of claim 17, wherein said alloy comprises from about 1.5 atomic percent to about 4 atomic percent ruthenium.

24. The turbine engine component of claim 23, wherein said alloy comprises about 2 atomic percent ruthenium.

25. The turbine engine component of claim 17, wherein said precipitation-strengthening metal comprises a material selected from the group consisting of zirconium, niobium, tantalum, and mixtures thereof.

26. The turbine engine component of claim 17, wherein said turbine engine component is a blade of an aircraft engine, a vane of an aircraft engine, a bucket of a power generation turbine engine, or a nozzle of a power generation turbine.

27. The turbine engine component of claim 26, wherein said turbine engine component comprises an airfoil, and wherein said airfoil comprises said alloy.

28. The turbine engine component of claim 27, wherein said airfoil comprises a tip section, a leading edge section, and a trailing edge section, and wherein at least one of said tip section, said leading edge section, and said trailing edge section comprises said alloy.

29. A turbine engine airfoil comprising an alloy, said alloy of said airfoil comprising about seven atomic percent of at least one precipitation-strengthening metal selected from the group consisting of zirconium, niobium, tantalum, and mixtures thereof, about two atomic percent ruthenium, and the balance comprising rhodium, said alloy of said turbine engine airfoil further comprising a face-centered-cubic phase and an $L1_2$—structured phase.

* * * * *